US006087819A

United States Patent [19]

Kuroda

[11] Patent Number: 6,087,819

[45] Date of Patent: Jul. 11, 2000

[54] CURRENT MIRROR CIRCUIT WITH MINIMIZED INPUT TO OUTPUT CURRENT ERROR

[75] Inventor: Hidehiko Kuroda, Tokyo, Japan

[73] Assignee: NEC Corporation, Tokyo, Japan

[21] Appl. No.: 09/187,568

[22] Filed: Nov. 5, 1998

[30] Foreign Application Priority Data

Nov. 5, 1997 [JP] Japan ..... 9-302921

[51] Int. Cl.[7] ..... G05F 3/16

[52] U.S. Cl. ..... 323/315

[58] Field of Search ..... 323/315

[56] References Cited

U.S. PATENT DOCUMENTS

| | | | |
|---|---|---|---|
| 4,558,272 | 12/1985 | Grosch | 323/315 |
| 4,814,724 | 3/1989 | Tanigawa | 323/315 |
| 4,994,730 | 2/1991 | Rossi et al. | 323/315 |
| 5,680,037 | 10/1997 | Carobolante | 323/315 |
| 5,966,039 | 10/1999 | Koglin et al. | 323/315 |
| 5,978,249 | 11/1999 | Koifman et al. | 323/315 |

*Primary Examiner*—Jeffrey Sterrett

[57] ABSTRACT

A current mirror circuit for outputting an output current in proportion to an input current, comprises a first transistor having a collector through which the input current flows, a second transistor having a base connected to a base of the first transistor and a collector through which the output current flows, a third transistor having a base connected to a collector of the first transistor, and an emitter through which a predetermined current flows, and a fourth transistor having a base connected to an emitter of the third transistor, and an emitter connected to the base of the first and second transistors. A variable current source is connected between an emitter of the third transistor and ground to cause the predetermined current to flow through the third transistor. The value of the predetermined current is variable. An input current detecting circuit is provided to detect the input current for controlling the variable current source so as to maintain the predetermined current in proportion to the input current.

18 Claims, 8 Drawing Sheets

CURRENT MIRROR CIRCUIT WITH MINIMIZED INPUT TO OUTPUT CURRENT ERROR

BACKGROUND OF THE INVENTION

1. Field of the Invention

The present invention relates to a current mirror circuit, and more specifically to a current mirror circuit suitable for a received signal indicator provided in a receiver for detecting a received electric field strength.

2. Description of Related Art

A receiver used in a communication system such as a PHS (personal handy-phone system) generally includes a received signal indicator for detecting a variation of a received electric field strength.

Referring to FIG. 1, there is shown a block diagram illustrating the construction of a conventional received signal indicator.

The shown received signal indicator, designated with Reference Numeral 102, is connected to a multi-stage amplifier 101 composed of a plurality of cascaded amplifiers for amplifying a received signal having an input power Pin. The received signal indicator 102 includes a detection circuit 103 for detecting an output power supplied from each of the amplifiers of the multi-stage amplifier 101, and a current mirror circuit 104 and a resistor $R_L$ for outputting, on the basis of an output of the detection circuit 103, a detection voltage $V_S$ in proportion to the input power Pin of the detection circuit 101. With this construction, a current Iref in proportion to the input power Pin of the detection circuit 101 is outputted from the detection circuit 103. Since the current mirror circuit 104 acting as a buffer amplifier is connected to the output of the detection circuit 103, an output current $I_O$ of the current mirror circuit 104 is caused to flow through the resistor $R_L$. Thus, the detection voltage $V_S$ in proportion to the input power Pin of the detection circuit 101 is outputted from between opposite ends of the resistor $R_L$.

Here, the current mirror circuit is a circuit operating to maintain a predetermined ratio between the input current Iref and the output current $I_O$. Referring to FIG. 2, there is shown a circuit diagram of the simplest construction of the current mirror circuit, which is well known to persons skilled in the art.

In the circuit construction shown in FIG. 2, however, since a base current $I_{B1}$ flowing between a base and an emitter of a transistor $Q_{101}$ and a base current $I_{B2}$ flowing between a base and an emitter of a transistor $Q_{102}$ flows into the input current Iref, the output current $I_O$ becomes as follows:

$$I_O = \mathrm{Iref} + I_{B1} + I_{B2}$$

In order to reduce the influence of the base currents, a current mirror circuit as shown in FIG. 3 has been proposed in the prior art.

The current mirror circuit shown in FIG. 3 includes a transistor $Q_{111}$ having an emitter connected through a resistor $R_{111}$ to a power supply voltage $V_{CC}$, a transistor $Q_{112}$ having a base connected to a base of the transistor $Q_{111}$ and an emitter connected through a resistor $R_{112}$ to the power supply voltage $V_{CC}$, a transistor $Q_{113}$ having a collector connected to the power supply voltage $V_{CC}$ and a base connected to a collector of the transistor $Q_{111}$, a transistor $Q_{114}$ having an emitter connected the bases of the transistors $Q_{111}$ and $Q_{112}$, a base connected to an emitter of the transistor $Q_{113}$, and a collector connected to ground, and a constant current source 112 having one end connected to the emitter of the transistor $Q_{113}$ and the other end connected to the ground.

Here, assume that a collector current of the transistor $Q_{111}$ is $I_{C1}$, a collector current of the transistor $Q_{112}$ is $I_{C2}$ ($=I_O$), a base current of the transistor $Q_{113}$ is $I_{B3}$, an emitter current of the transistor $Q_{114}$ is $I_{E4}$, a base current of the transistor $Q_{114}$ is $I_{B4}$, and a current of the constant current source 112 is Ia. A relation between the output current $I_O$ and the input current Iref is expressed as follows:

$$\begin{aligned}
I_{E4} &= \frac{I_{C1}}{h_{FEP}} + \frac{I_{C2}}{h_{FEP}} = \frac{2I_{C2}}{h_{FEP}} \\
I_{B4} &= \frac{I_{E4}}{h_{FEP}+1} = \frac{2I_{C2}}{h_{FEP}(h_{FEP}+1)} \\
I_{B3} &= \frac{Ia - I_{B4}}{h_{FEN}+1} = \frac{Ia}{h_{FEN}+1} - \frac{2I_{C2}}{h_{FEP}(h_{FEP}+1)(h_{FEN}+1)} \\
Iref &= I_{C1} - I_{B3} = I_{C2} - I_{B3} \\
I_O &= I_{C2} = Iref + \frac{Ia}{h_{FEN}+1} - \frac{2I_{C2}}{h_{FEP}(h_{FEP}+1)(h_{FEN}+1)} \\
\therefore I_O &= \frac{h_{FEP}(h_{FEP}+1)(h_{FEN}+1)}{h_{FEP}(h_{FEP}+1)(h_{FEN}+1)+2}\left\{Iref + \frac{Ia}{h_{FEN}+1}\right\} \\
&\approx Iref + \frac{Ia}{h_{FEN}+1}
\end{aligned} \tag{1}$$

where $h_{FEP}$ is a current amplification factor of the PNP transistors ($Q_{111}$, $Q_{112}$ and $Q_{114}$) and $h_{FEN}$ is a current amplification factor of the NPN transistors ($Q_{113}$).

As seen from the above equation (1), the prior art current mirror circuit shown in FIG. 3 has an error of $Ia/(h_{FEN}+1)$ between the input current Iref and the output current $I_O$. However, since it is generally that $h_{FEP}$, $h_{FEN} >> 1$, the error in the prior art current mirror circuit shown in FIG. 3 can be made smaller than that in the current mirror circuit shown in FIG. 2.

However, in the case that the prior art current mirror circuit shown in FIG. 3 is incorporated in the received signal indicator, since the value of the input current Iref varies in a logarithmic characteristics, the error becomes large when the value of the input current Iref becomes small. The reason for this is that, since the error of $Ia/(h_{FEN}+1)$ exists between the input current Iref and the output current $I_O$ as shown in the equation (1), the smaller the value of the input current Iref becomes, the larger the influence of the output current Ia (constant value) of the constant current source becomes non-negligibly. In addition, since the value of the current amplification factors $h_{FEP}$ and $h_{FEN}$ greatly varies dependently upon the manufacturing process, if the value of the current amplification factors $h_{FEP}$ and $h_{FEN}$ becomes small, the error between the input current Iref and the output current $I_O$ becomes large.

SUMMARY OF THE INVENTION

Accordingly, it is an object of the present invention to provide a current mirror circuit which has overcome the above mentioned defect of the conventional one.

Another object of the present invention is to provide a current mirror circuit having a minimized error of an output current to an input current even if the change of the input current is large and even if the variation of current amplification factors is large.

The above and other objects of the present invention are achieved in accordance with the present invention by a current mirror circuit for outputting an output current in proportion relation to an input current, comprising:

a first transistor having a collector through which the input current flows;

a second transistor having a base connected to a base of the first transistor and a collector through which the output current flows;

a third transistor having a base connected to a collector of the first transistor, and an emitter through which a predetermined current flows;

a fourth transistor having a base connected to an emitter of the third transistor, and an emitter connected to the base of the first and second transistors;

a variable current source connected to cause the predetermined current to flow through the third transistor, the value of the predetermined current being variable; and an input current detecting circuit detecting the input current for controlling the variable current source so as to maintain the predetermined current in proportion to the input current.

In a preferred embodiment of the current mirror circuit, the input current detecting circuit includes:

a fifth transistor having a base connected to the bases of the first and second transistors and a collector through which a current equal to the current flowing through the collector of the first transistor flows;

a sixth transistor connected in series to the fifth transistor; and a seventh transistor having a base connected to a collector of the sixth transistor and a collector connected to a base of the sixth transistor.

In addition, the variable current source includes an eighth transistor having a base connected to the base of the sixth transistor.

According to another aspect of the present invention, there is provided a current mirror circuit for outputting an output current in proportion to an input current, comprising:

a first transistor having a collector through which the input current flows;

a second transistor having a base connected to a base of the first transistor and a collector through which the output current flows;

a third transistor having a base connected to a collector of the first transistor, and an emitter through which a predetermined current flows;

a variable current source connected to cause the predetermined current to flow through the third transistor, the value of the predetermined current being variable; and an input current detecting circuit detecting the input current for controlling the variable current source so as to maintain the predetermined current in proportion to the input current.

In a preferred embodiment of this current mirror circuit, the input current detecting circuit includes:

a fourth transistor having a base connected to the emitter of the third transistor and an emitter connected to the bases of the first and second transistors; and a fifth transistor connected in series to the fourth transistor, and having a collector and a base connected to each other.

In addition, the variable current source includes a sixth transistor having a base connected to the base of the fifth transistor.

In a specific embodiment, the above mentioned input current can be a current outputted from a detecting circuit for detecting a received electric field strength.

In the current mirror circuit having the above mentioned construction, the predetermined current is caused to flow through the third transistor by the variable current source, and the value of the predetermined current is variable. In addition, the input current is detected by the input current detecting circuit, and the current flowing through the variable current source is controlled to be in proportion to the input current by the input current detecting circuit. Therefore, if the input current becomes small, the current of the variable current source correspondingly becomes small. Accordingly, even if the input current greatly changes, the error between the input current and the output current in the current mirror circuit can be minimized.

The above and other objects, features and advantages of the present invention will be apparent from the following description of preferred embodiments of the invention with reference to the accompanying drawings.

DESCRIPTION OF THE PREFERRED EMBODIMENTS

Figure 4:
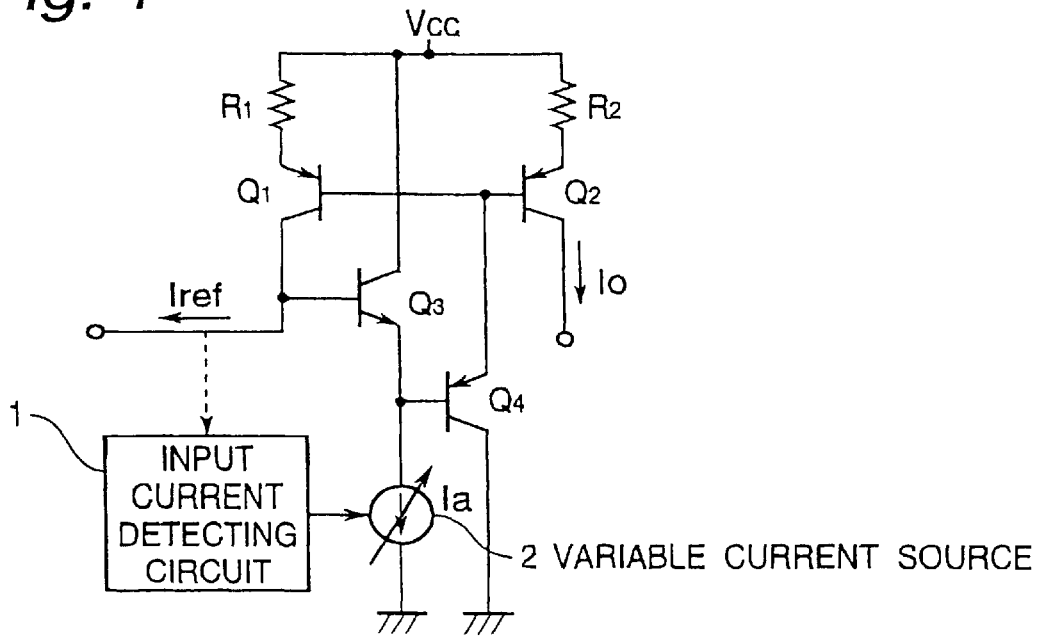
FIG. 4 is a block diagram illustrating a basic construction of the current mirror circuit in accordance with the present invention.

Referring to FIG. 4, there is shown a block diagram illustrating a basic construction of the current mirror circuit in accordance with the present invention.

Figure 1:
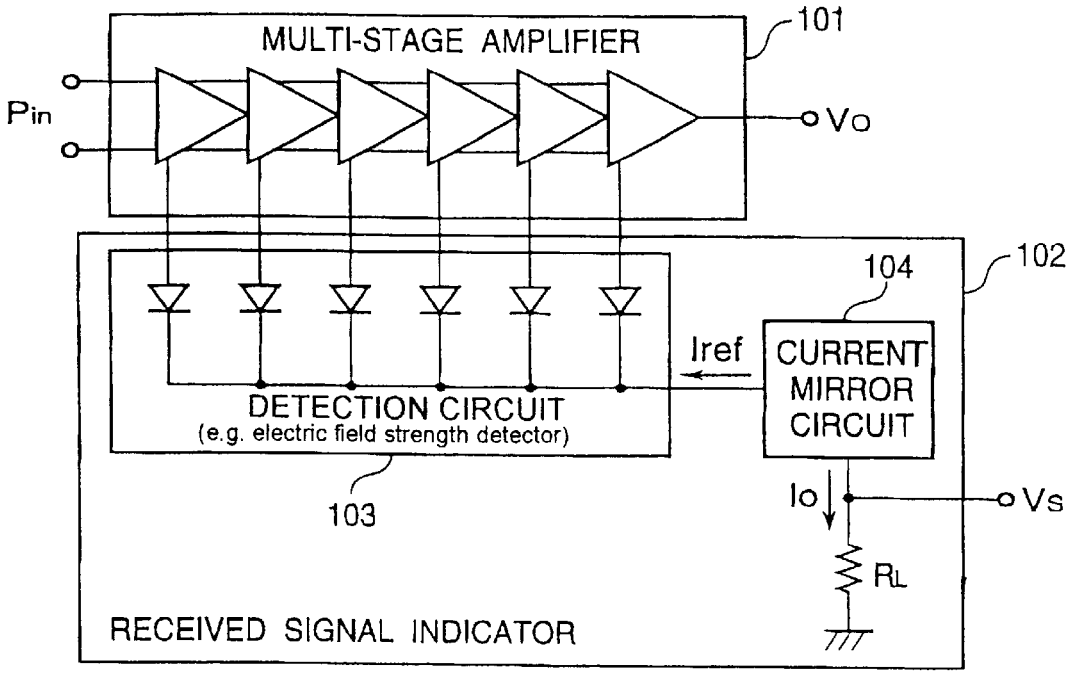
Fig. 1 PRIOR ART
FIG. 1 is a block diagram illustrating the construction of a conventional received signal indicator.
Figure 2:
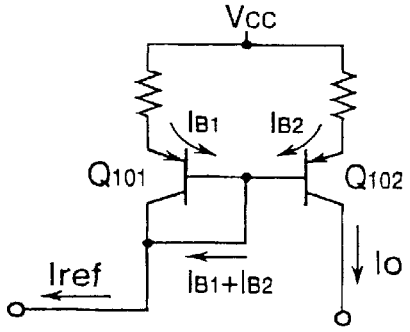
Fig. 2 PRIOR ART
FIG. 2 is a circuit diagram of the simplest construction of the current mirror circuit, which is well known to persons skilled in the art.

The current mirror circuit shown in FIG. 1 includes a transistor $Q_1$ having an emitter connected through a resistor $R_1$ to a power supply voltage $V_{CC}$, a transistor $Q_2$ having a base connected to a base of the transistor $Q_1$ and an emitter connected through a resistor $R_2$ to the power supply voltage $V_{CC}$, a transistor $Q_3$ having a collector connected to the power supply voltage $V_{CC}$, a base connected to a collector of the transistor $Q_1$, and a transistor $Q_4$ having an emitter connected to the bases of the transistors $Q_1$ and $Q_2$, a base connected to an emitter of the transistor $Q_3$, and a collector connected to ground. An input current Iref is caused to flow from a collector of the transistor $Q_1$, and an output current $I_O$ is taken from a collector of the transistor $Q_2$.

The current mirror circuit shown in FIG. 1 also includes a variable current source 2 having one end connected to an emitter of the transistor $Q_3$ and the other end connected to the ground, and an input current detecting circuit 1 detecting the input current Iref of the current mirror circuit for controlling the output current Ia of the variable current source 2.

With this arrangement, the input current detecting circuit 1 detects the value of the input current Iref for controlling the variable current source 2 so as to maintain the value of the output current Ia of the variable current source 2 in proportion to the value of the input current Iref.

Accordingly, if the input current Iref becomes small, the output current Ia of the variable current source 2 correspondingly becomes small. Thus, even if the input current Iref greatly changes, an error between the input current Iref and the output current $I_O$ of the current mirror circuit can be minimized.

Figure 3:
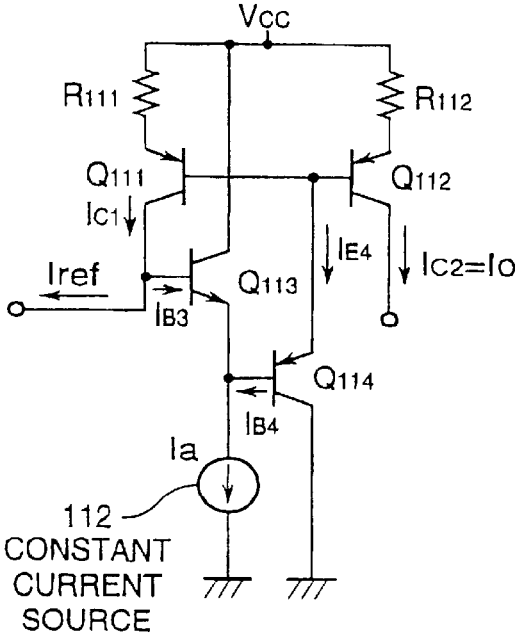
Fig. 3 PRIOR ART
FIG. 3 is a circuit diagram of another prior art current mirror circuit.

As seen from the above, the current mirror circuit in accordance with the present invention shown in FIG. 4 is characterized in that, the constant current source in the prior art current mirror circuit shown in FIG. 3 is replaced with the variable current source 2 having the output current Ia which is changed or varied in accordance with the change of the input current Iref by the input current detecting circuit 1.

Figure 5:
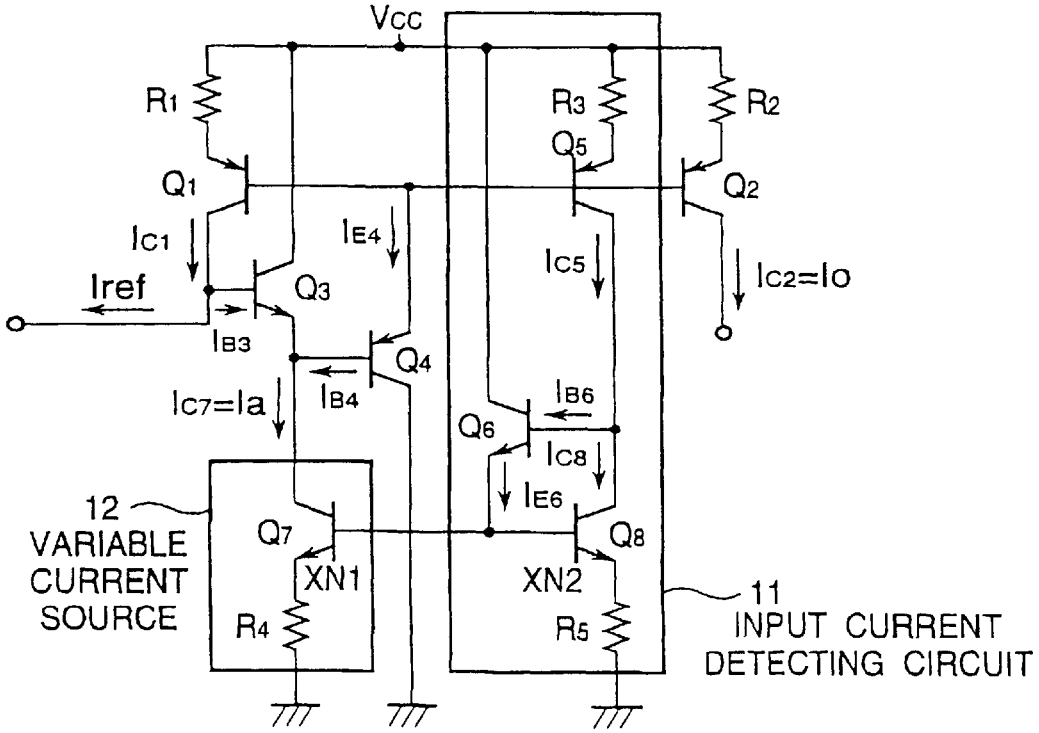
FIG. 5 is a circuit diagram of a first embodiment of the current mirror circuit in accordance with the present invention.

Referring to FIG. 5, there is shown a circuit diagram of a first embodiment of the current mirror circuit in accordance with the present invention. In FIG. 5, elements corresponding to those shown in FIG. 4 are given the same Reference Numerals, and explanation will be omitted.

In the current mirror circuit shown in FIG. 5, an input current detecting circuit 11 (corresponding to the input current detecting circuit 1 in FIG. 1) includes a transistor $Q_5$ having a base connected to the bases of the transistors $Q_1$ and $Q_2$ and an emitter connected through a resistor $R_3$ to the power supply voltage $V_{CC}$, a transistor $Q_6$ having a collector connected to the power supply voltage $V_{CC}$ and a base connected to a collector of the transistor $Q_5$, and a transistor $Q_8$ having a collector connected to the collector of the transistor $Q_5$ and the base of the transistor $Q_6$, a base connected to an emitter of the transistor $Q_6$, and an emitter connected through a resistor $R_5$ to the ground. In this input current detecting circuit 11, the transistor $Q_5$ is connected in the same circuit connection as that of the transistor $Q_1$, so that a current flowing through the collector of the transistor $Q_5$ is made equal to the input current Iref, with the result that the input current Iref is equivalently detected.

A variable current source 12 (corresponding to the variable current source 2 in FIG. 1) includes a transistor $Q_7$ having a collector connected to the emitter of the transistor $Q_3$, an emitter connected through a resistor $R_4$ to the ground and a base connected to the emitter of the transistor $Q_6$ and the base of the transistor $Q_8$ in the input current detecting circuit 11. Here, if an emitter area ratio between the transistors $Q_7$ and $Q_8$ is expressed by $Q_7:Q_8=N_1:N_2$, respective resistance of the resistors $R_4$ and $R_5$ are in the relation of $R_4 \cdot N_1=R_5 \cdot N_2$.

In the construction shown in FIG. 5, assume that a collector current of the transistor $Q_1$ is $I_{C1}$, a collector current of the transistor $Q_2$ is $I_{C2}$ (=$I_O$), a base current of the transistor $Q_3$ is $I_{B3}$, an emitter current of the transistor $Q_4$ is $I_{E4}$, a base current of the transistor $Q_4$ is $I_{B4}$, a collector current of the transistor $Q_5$ is $I_{C5}$, a base current of the transistor $Q_6$ is $I_{B6}$, an emitter current of the transistor $Q_6$ is $I_{E6}$, a collector current of the transistor $Q_8$ is $I_{C8}$, and a collector current of the transistor $Q_7$ is $I_{C7}$ (=Ia). In this condition, a relation between the output current $I_O$ and the input current Iref is expressed as follows:

$$I_{E4} = \frac{I_{C1}}{h_{FEP}} + \frac{I_{C5}}{h_{FEP}} + \frac{I_{C2}}{h_{FEP}} = \frac{3I_{C4}}{h_{FEP}} = \frac{3I_{C2}}{h_{FEP}} \tag{2}$$

$$I_{E6} = \frac{I_{C8}}{h_{FEN}} + \frac{I_{C7}}{h_{FEN}}$$

$$I_{B6} = \frac{I_{E6}}{h_{FEN}+1} = \frac{I_{C8}+I_{C7}}{h_{FEN}(h_{FEN}+1)}$$

$$I_{C7} = \frac{N_1}{N_2} I_{C8} (\text{where } R4N_1 = R5N_2)$$

$$I_{B5} = \frac{I_{E4}}{h_{FEP}+1} = \frac{3I_{C2}}{h_{FEP}(h_{FEP}+1)}$$

$$I_{B4} = \frac{I_{C7}-I_{B4}}{h_{FEN}+1} = \frac{1}{h_{FEN}+1} I_{C7} - \frac{3I_{C2}}{h_{FEP}(h_{FEP}+1)(h_{FEN}+1)}$$

$$Iref = I_{C1} - I_{B3} = I_{C2} - I_{B3}$$

$$I_O = I_{C2} =$$

$$Iref + I_{B3} = Iref + \frac{1}{h_{FEN}+1}\frac{N_1}{N_2} I_{C8} - \frac{3I_O}{h_{FEP}(h_{FEP}+1)(h_{FEN}+1)}$$

$$\therefore I_O \approx Iref + \frac{N_1}{N_2(h_{FEN}+1)} I_{C8} \quad (\because I_{C8} \approx I_{C1} = Iref - I_{B3})$$

$$\approx Iref\left\{1 + \frac{N_1}{N_2(h_{FEN}+1)}\right\} - \frac{N_1}{N_2(h_{FEN}+1)^2} I_{C7}.$$

where $h_{FEP}$ is a current amplification factor of the PNP transistors ($Q_1$, $Q_2$, $Q_4$ and $Q_5$) and $h_{FEN}$ is a current amplification factor of the NPN transistors ($Q_3$, $Q_6$, $Q_7$ and $Q_8$).

Thus, if the input current Iref changes, the collector current $I_{C8}$ of the transistor $Q_8$ changes with the intermediary of the transistor $Q_5$, and the collector current $I_{C7}$ of the transistor $Q_7$ changes in proportion to the collector current $I_{C8}$.

In addition, as seen from the equation (2), since the output current $I_O$ is a function of the input current Iref, if the input current Iref becomes a small value, the current $I_{C7}$ (=Ia) flowing through the variable current source 12 also becomes small, and therefore, the base current $I_{B3}$ of the transistor $Q_3$ correspondingly becomes small, with the result that the error between the input current Iref and the output current $I_O$ becomes small. Since the error is in proportion to $1/(h_{FEN}+1)^2$, even if the value of the current amplification factors $h_{FEN}$ and $h_{FEP}$ becomes small, the error between the input current Iref and the output current $I_O$ becomes small in comparison with the prior art current mirror circuit.

Figure 6:
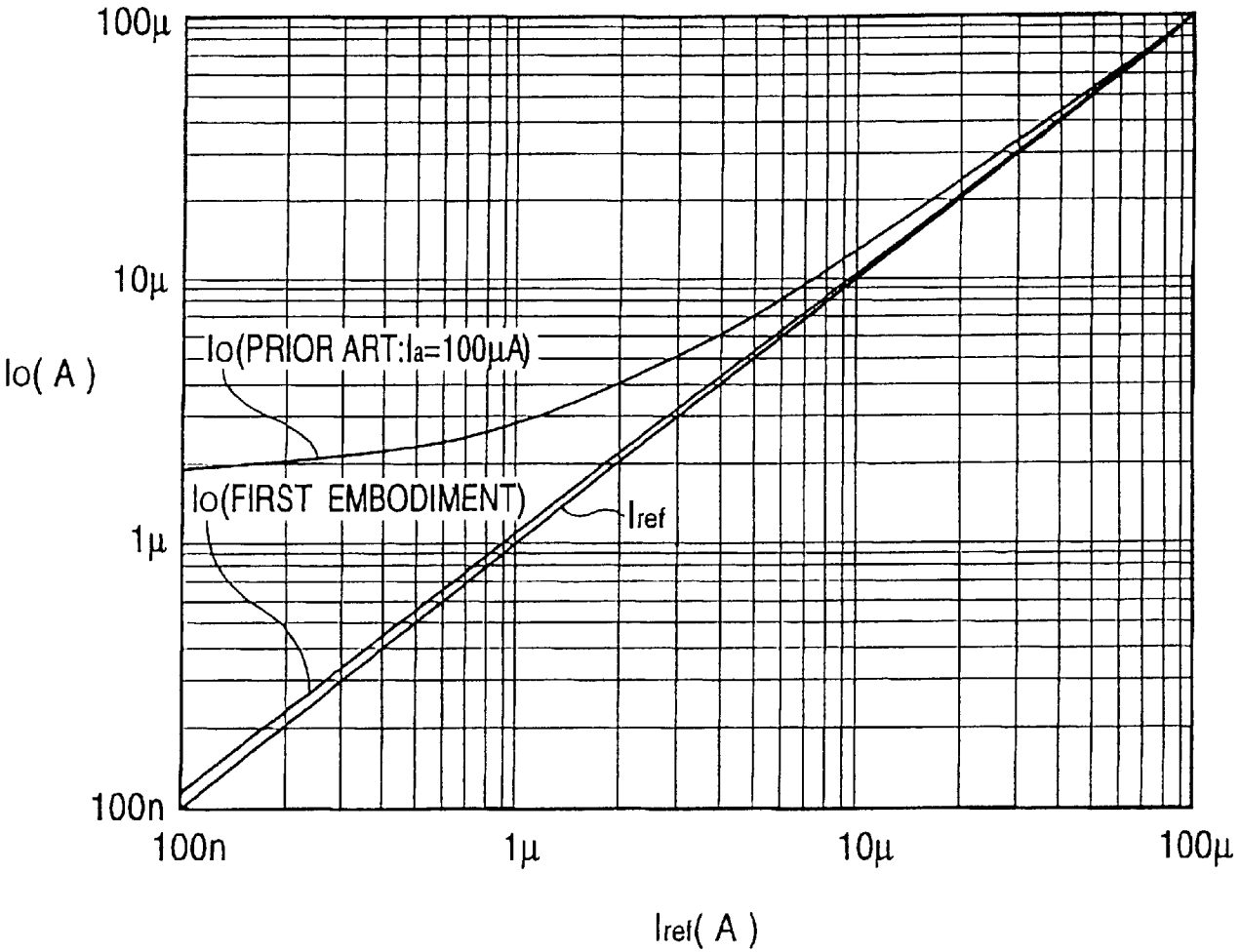
FIG. 6 is a graph illustrating a relation between the output current and the change of the input current in the current mirror circuit shown in FIG. 5.
Figure 7:
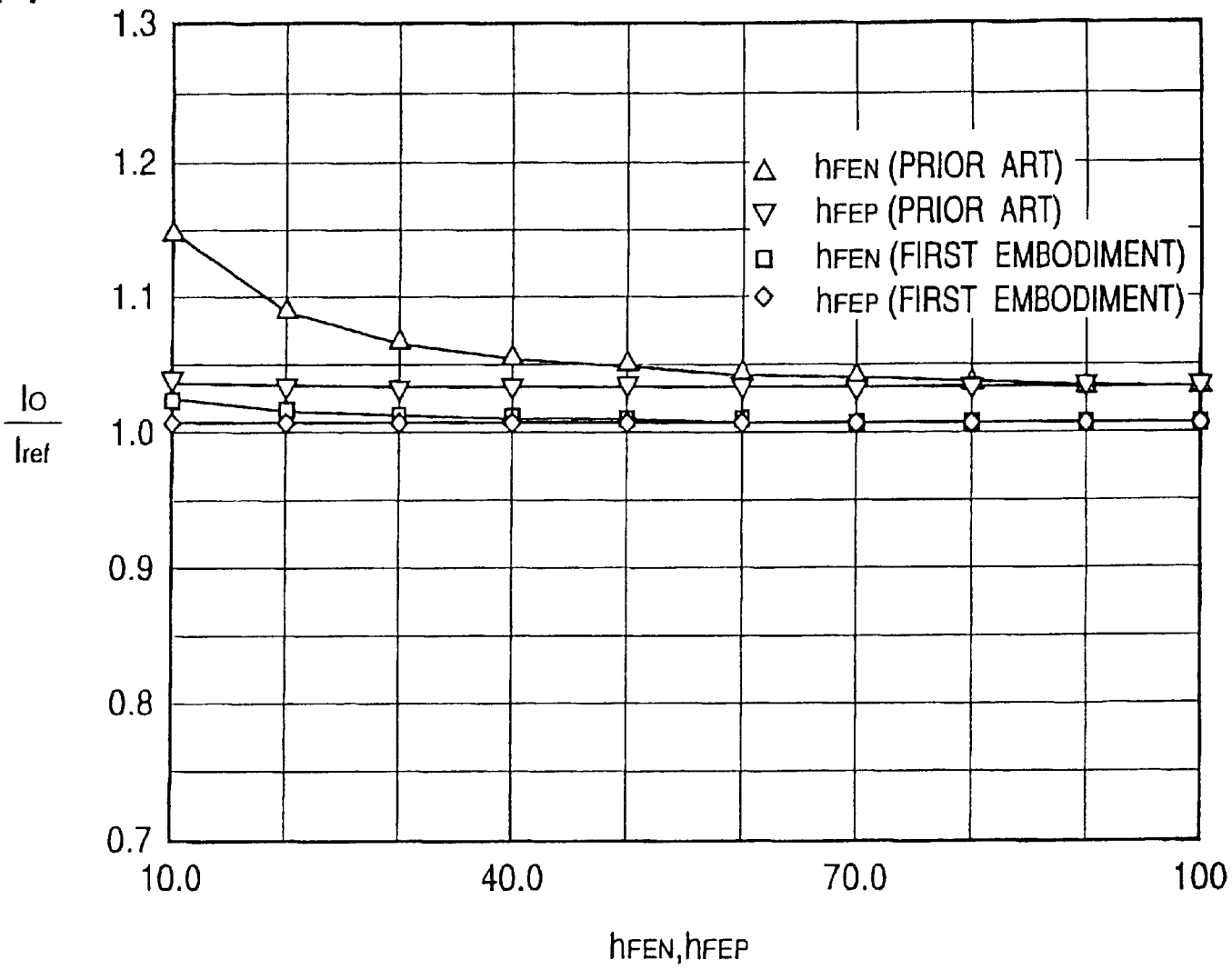
FIG. 7 is a graph illustrating a relation between the output current to input current ratio and the variation of the current amplification factors in the current mirror circuit shown in FIG. 5.

Here, a relation between the input current Iref and the output current $I_O$ in the current mirror circuit shown in FIG. 5 becomes as shown in the graph of FIG. 6 (where a mirror ratio=1). For reference, the graph of FIG. 6 additionally shows the relation between the input current Iref and the output current $I_O$ in the prior art current mirror circuit. In addition, a relation between the output current to input current ratio "$I_O$/Iref" and the variation of the current amplification factors $h_{FEN}$ and $h_{FEP}$ in the current mirror circuit shown in FIG. 5 becomes as shown in the graph of FIG. 7 (where a mirror ratio=1). For reference, the graph of FIG. 7 additionally shows the relation between the output current to input current ratio "$I_O$/Iref" and the variation of the current amplification factors $h_{FEN}$ and $h_{FEP}$ in the prior art current mirror circuit.

It would be understood from FIG. 6 that, in the current mirror circuit of the first embodiment, even if the value of the input current Iref greatly changes in a range of a few digits, the value of the output current $I_O$ closely follows the value of the input current Iref, and even if the input current Iref becomes small, the error never becomes large, clearly differently from the prior art. In addition, it would be understood from FIG. 7 that, in the current mirror circuit of the first embodiment, the error is maintained at a small value independently of the variation of the current amplification factors $h_{FEN}$ and $h_{FEP}$.

Figure 8:
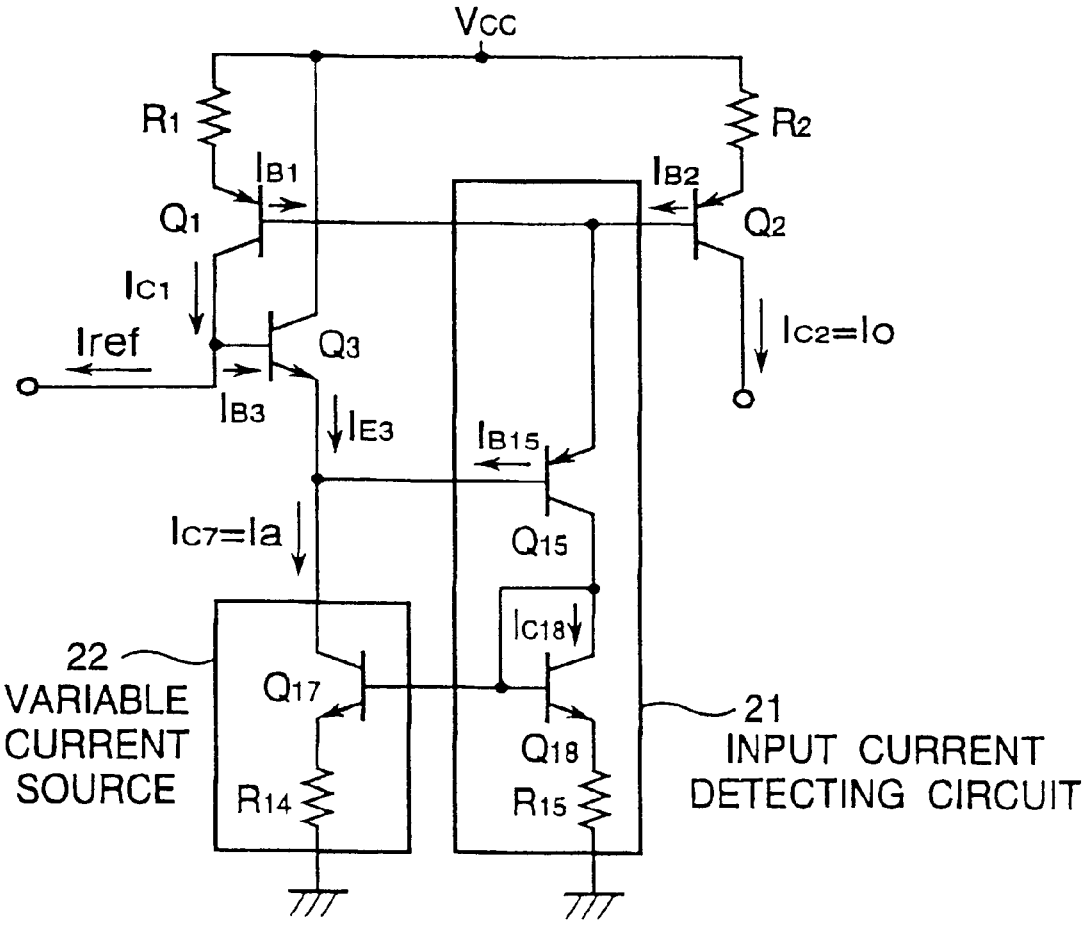
FIG. 8 is a circuit diagram of a second embodiment of the current mirror circuit in accordance with the present invention.

Referring to FIG. 8, there is shown a circuit diagram of a second embodiment of the current mirror circuit in accordance with the present invention. In FIG. 8, elements corresponding to those shown in FIG. 4 are given the same Reference Numerals, and explanation will be omitted.

In the current mirror circuit shown in FIG. 8, an input current detecting circuit 21 (corresponding to the input current detecting circuit 1 in FIG. 1) includes a transistor $Q_{15}$ having an emitter connected to the bases of the transistors $Q_1$ and $Q_2$ and a base connected to the emitter of the transistor $Q_3$, and a transistor $Q_{18}$ having a collector and a base connected in common to a collector of the transistor $Q_{15}$ and an emitter connected through a resistor $R_{15}$ to the ground. In this input current detecting circuit 21, the transistor $Q_{15}$ detects the base current of the transistor $Q_3$ to feed back the detection result to the bases of the transistors $Q_1$ and $Q_2$, similarly to the transistor $Q_4$ in FIG. 4. In addition, the transistors $Q_{15}$ and $Q_{18}$ detect the base currents of the transistors $Q_1$ and $Q_2$, so that the input current Iref of the current mirror circuit is equivalently detected.

A variable current source 22 (corresponding to the variable current source 2 in FIG. 1) includes a transistor $Q_{17}$ having a collector connected to the emitter of the transistor $Q_3$, an emitter connected through a resistor $R_{14}$ to the ground and a base connected to the base of the transistor $Q_{18}$ in the input current detecting circuit 21. Here, if an emitter area ratio between the transistors $Q_{17}$ and $Q_{18}$ is expressed by $Q_{17}:Q_{18}=N_1:N_2$, respective resistance of the resistors $R_{14}$ and $R_{15}$ are in the relation of $R_{14}\cdot N_1=R_{15}\cdot N_2$.

In the construction shown in FIG. 8, assume that a collector current of the transistor $Q_1$ is $I_{C1}$, a collector current of the transistor $Q_2$ is $I_{C2}$ (=$I_O$), a base current of the transistor $Q_1$ is $I_{B1}$, a base current of the transistor $Q_2$ is $I_{B2}$, a base current of the transistor $Q_3$ is $I_{B3}$, a base current of the transistor $Q_{15}$ is $I_{B15}$, and a collector current of the transistor $Q_{17}$ is $I_{C17}$ (=Ia). In this condition, a relation between the output current $I_O$ and the input current Iref is expressed as follows:

$$Iref = I_{C1} - I_{B3} = I_O - I_{B3} \tag{3}$$

$$I_{B3} = \frac{I_{E3}}{h_{FEN}+1}$$

$$I_{C17} = \frac{N_1}{N_2} I_{C18} \quad (\text{where } R14N_1 = R15N_2)$$

-continued $$I_{C17} = I_{E3} + I_{B15} = I_{E3} + \frac{I_{B1}+I_{B2}}{h_{FEP}+1} = I_{E3} + \frac{I_{C1}+I_{C2}}{h_{FEP}(h_{FEP}+1)}$$

$$= I_{E3} + \frac{2I_O}{h_{FEP}(h_{FEP}+1)}$$

$$I_{B3} = \frac{I_{E3}}{h_{FEN}+1} = \frac{I_{C17}}{h_{FEN}+1} - \frac{2I_O}{h_{FEP}(h_{FEP}+1)(h_{FEN}+1)}$$

$$Iref = \left\{1 + \frac{2}{h_{FEP}(h_{FEP}+1)(h_{FEN}+1)}\right\} I_O - \frac{I_{C17}}{h_{FEN}+1}$$

$$\therefore I_O = \frac{h_{FEP}(h_{FEP}+1)(h_{FEN}+1)}{h_{FEP}(h_{FEP}+1)(h_{FEN}+1)+2}\left\{Iref + \frac{I_{C17}}{h_{FEN}+1}\right\}$$

$$\approx Iref + \frac{I_{C17}}{h_{FEN}+1}$$

where $h_{FEP}$ is a current amplification factor of the PNP transistors ($Q_1$, $Q_2$, and $Q_{15}$) and $h_{FEN}$ is a current amplification factor of the NPN transistors ($Q_3$, $Q_{17}$ and $Q_{18}$).

In the circuit shown in FIG. 8, since a current mirror circuit is constituted of the transistor $Q_{17}$ and the transistor $Q_{18}$ in the input current detecting circuit 21, if the input current Iref changes, the collector current $I_{C18}$ of the transistor $Q_{18}$ changes, and the collector current $I_{C17}$ of the transistor $Q_{17}$ changes in proportion to the collector current $I_{C18}$.

In addition, as seen from the equation (3), since the output current $I_O$ is a function of the input current Iref, if the input current Iref becomes a small value, similarly to the first embodiment, the current $I_{C17}$ (=Ia) flowing through the variable current source 22 also becomes small, and therefore, the base current $I_{B3}$ of the transistor $Q_3$ correspondingly becomes small, with the result that the error between the input current Iref and the output current $I_O$ becomes small.

Figure 9:
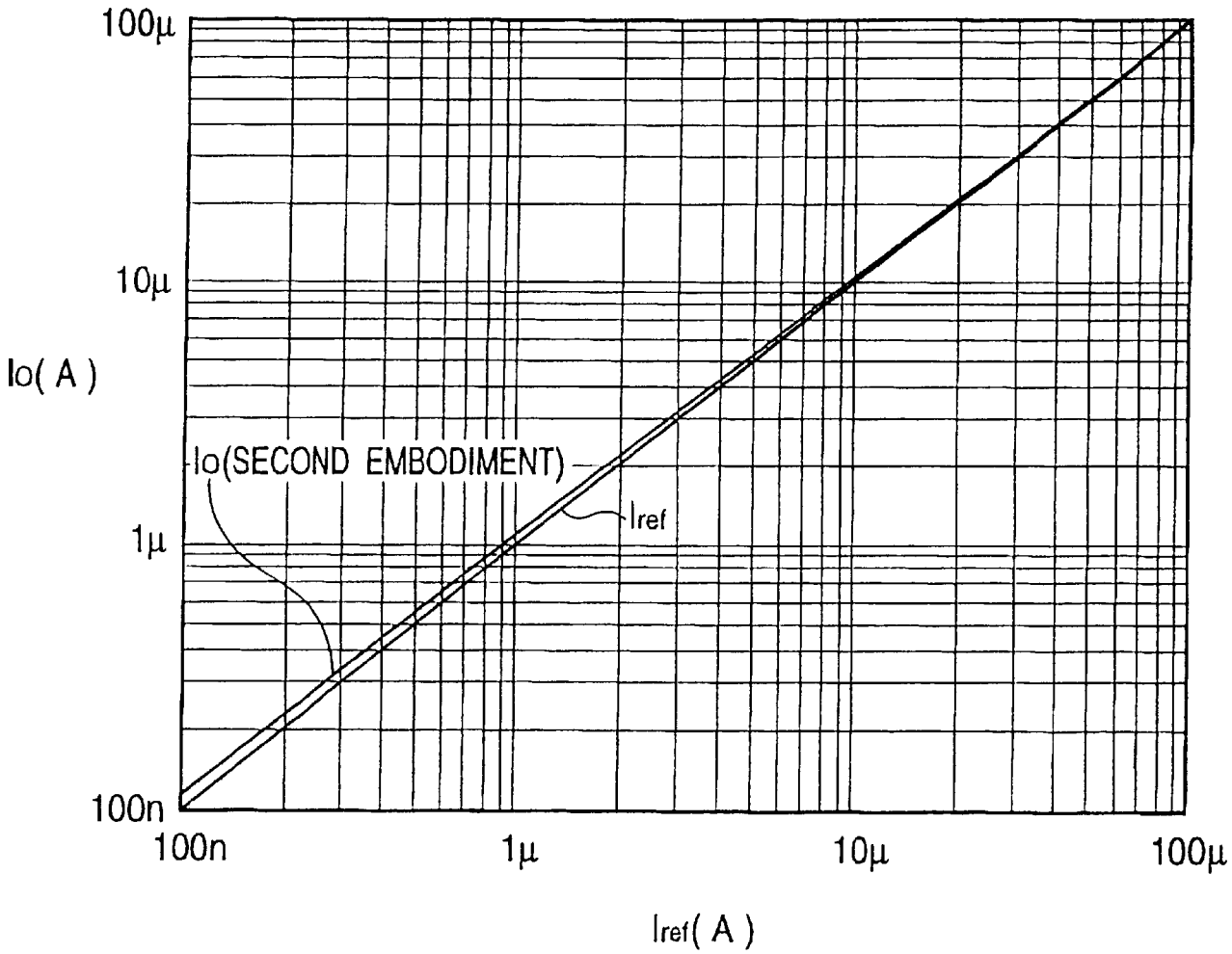
FIG. 9 is a graph illustrating a relation between the output current and the change of the input current in the current mirror circuit shown in FIG. 8.
Figure 10:
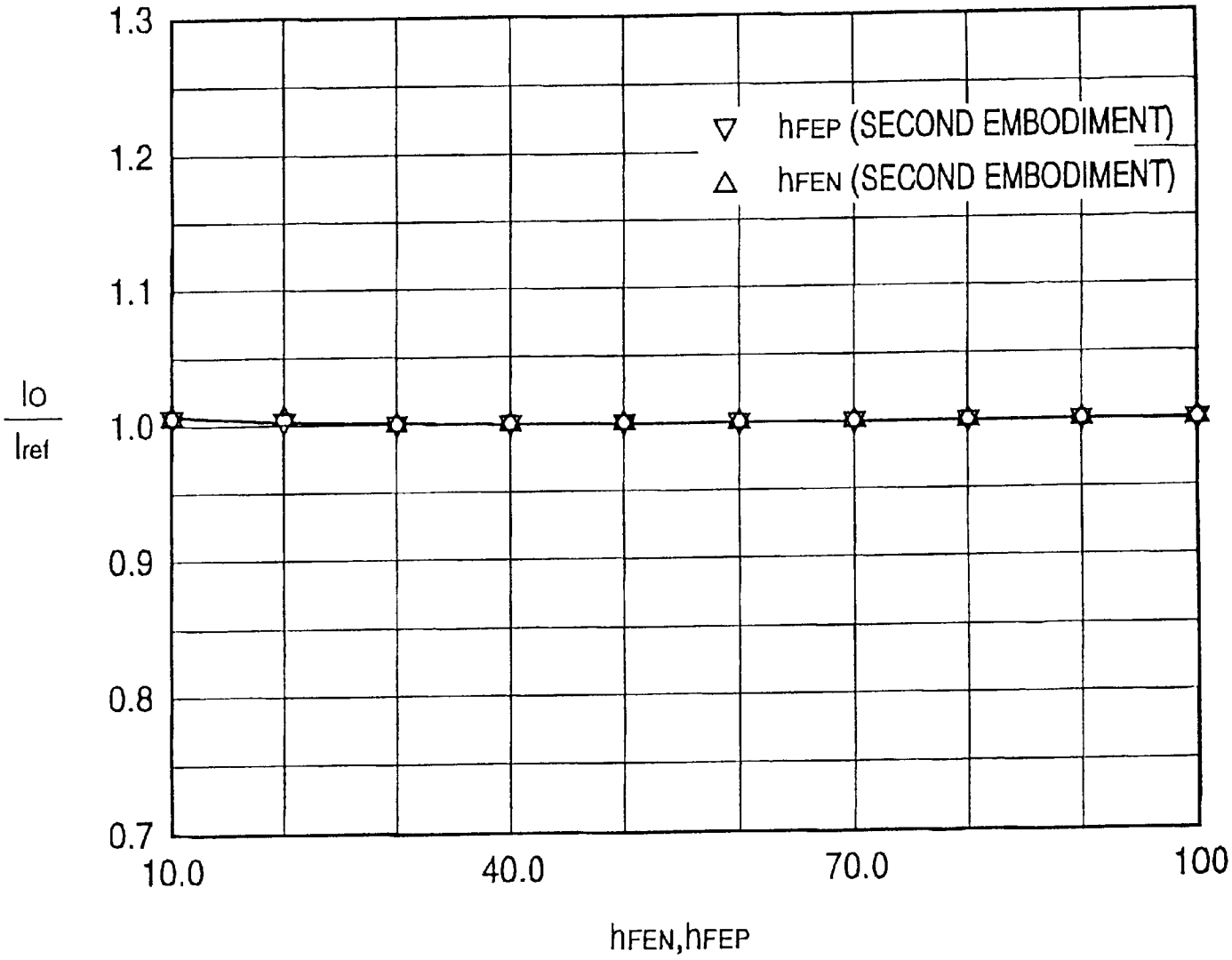
FIG. 10 is a graph illustrating a relation between the output current to input current ratio and the variation of the current amplification factors in the current mirror circuit shown in FIG. 8.

Here, a relation between the input current Iref and the output current $I_O$ in the current mirror circuit shown in FIG. 8 becomes as shown in the graph of FIG. 9 (where a mirror ratio=1). In addition, a relation between the output current to input current ratio "$I_O$/Iref" and the variation of the current amplification factors $h_{FEN}$ and $h_{FEP}$ in the current mirror circuit shown in FIG. 8 becomes as shown in the graph of FIG. 10 (where a mirror ratio=1).

It would be understood from FIG. 9 that, in the current mirror circuit of the second embodiment, similarly to the first embodiment, even if the value of the input current Iref greatly changes in a range of a few digits, the value of the output current $I_O$ closely follows the value of the input current Iref, and even if the input current Iref becomes small, the error never becomes large, clearly differently from the prior art. In addition, it would be understood from FIG. 10 that, in the current mirror circuit of the second embodiment, the error is maintained at a small value independently of the variation of the current amplification factors $h_{FEN}$ and $h_{FEP}$. On the other hand, since the second embodiment can be constituted of the transistors of the number smaller than that of the transistors required in the first embodiment, the necessary circuit area can be reduced.

Figure 11:
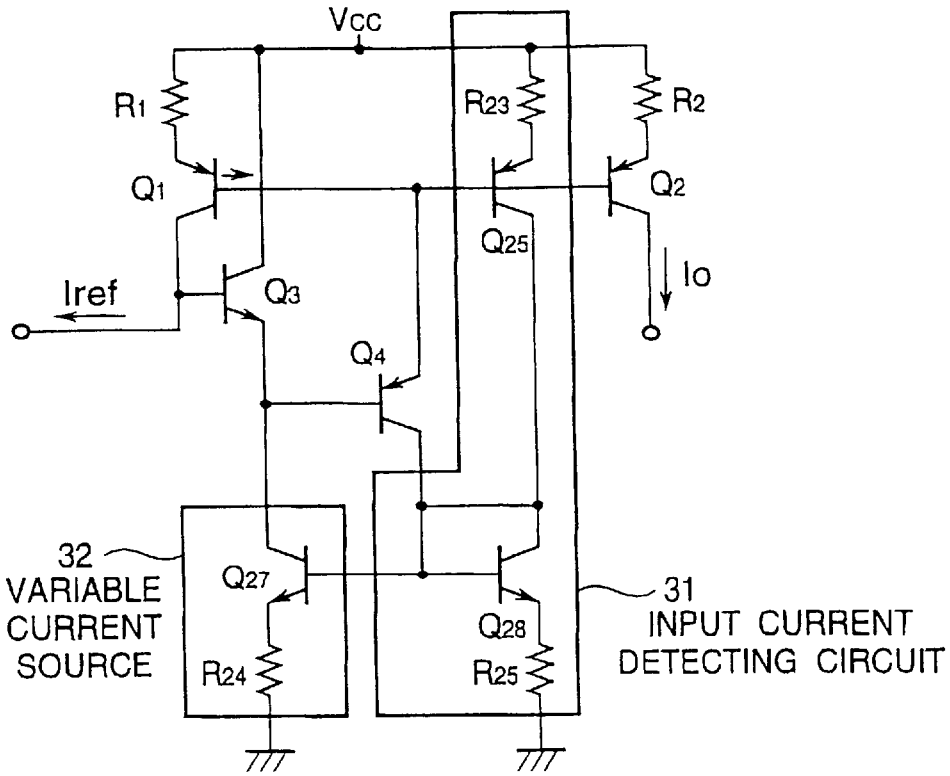
FIG. 11 is a circuit diagram of a third embodiment of the current mirror circuit in accordance with the present invention.

Referring to FIG. 11, there is shown a circuit diagram of a third embodiment of the current mirror circuit in accordance with the present invention. In FIG. 11, elements corresponding to those shown in FIG. 4 are given the same Reference Numerals, and explanation will be omitted.

In the current mirror circuit shown in FIG. 11, an input current detecting circuit 31 (corresponding to the input current detecting circuit 1 in FIG. 1) includes a transistor $Q_{25}$ having a base connected to the bases of the transistors $Q_1$ and $Q_2$ and an emitter connected through a resistor $R_{23}$ to the power supply voltage $V_{CC}$, and a transistor $Q_{28}$ having a collector and a base connected in common to the collector of the transistor $Q_{25}$ and the collector of the transistor $Q_4$, and an emitter connected through a resistor $R_{25}$ to the ground. In this input current detecting circuit 31, the transistor $Q_{25}$ is connected in the same circuit connection as that of the transistor $Q_1$, so that a current flowing through the collector of the transistor $Q_{25}$ is made equal to the input current Iref, with the result that the input current Iref is equivalently detected.

A variable current source 32 (corresponding to the variable current source 2 in FIG. 1) includes a transistor $Q_{27}$ having a collector connected to the emitter of the transistor $Q_3$, an emitter connected through a resistor $R_{24}$ to the ground and a base connected to the base of the transistor $Q_{28}$ in the input current detecting circuit 31.

Figure 12:
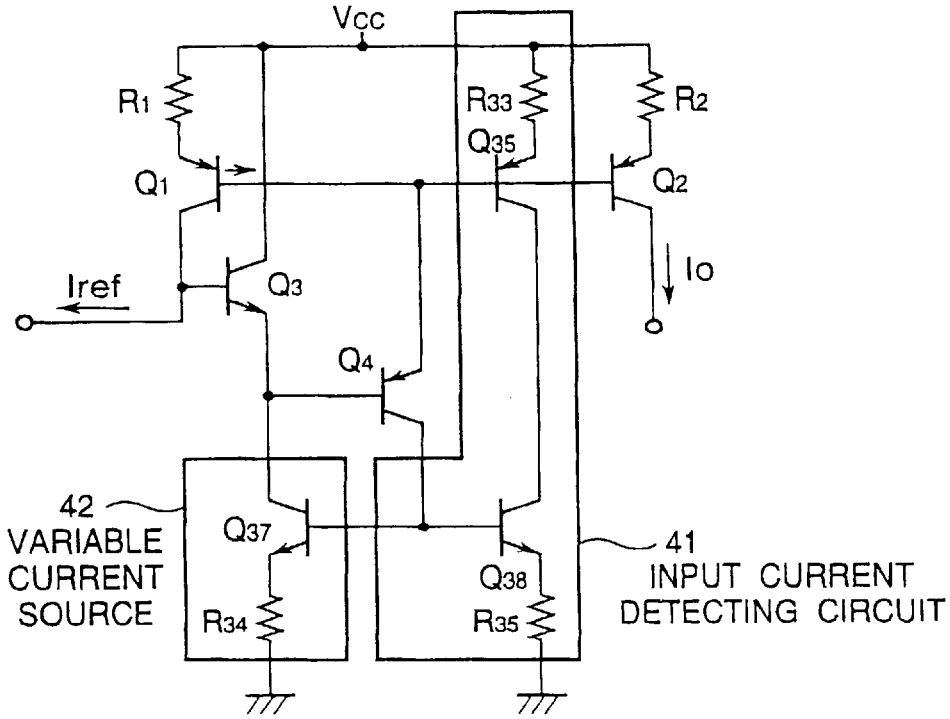
FIG. 12 is a circuit diagram of a fourth embodiment of the current mirror circuit in accordance with the present invention.

Referring to FIG. 12, there is shown a circuit diagram of a fourth embodiment of the current mirror circuit in accordance with the present invention. In FIG. 12, elements corresponding to those shown in FIG. 4 are given the same Reference Numerals, and explanation will be omitted.

In the current mirror circuit shown in FIG. 12, an input current detecting circuit 41 (corresponding to the input current detecting circuit 1 in FIG. 1) includes a transistor $Q_{35}$ having a base connected to the bases of the transistors $Q_1$ and $Q_2$ and an emitter connected through a resistor $R_{33}$ to the power supply voltage $V_{CC}$, and a transistor $Q_{38}$ having a collector connected to the collector of the transistor $Q_{35}$, a base connected to the collector of the transistor $Q_4$, and an emitter connected through a resistor $R_{35}$ to the ground. In this input current detecting circuit 41, the transistor $Q_{35}$ is connected in the same circuit connection as that of the transistor $Q_1$, so that a current flowing through the collector of the transistor $Q_{35}$ is made equal to the input current Iref, with the result that the input current Iref is equivalently detected.

A variable current source 42 (corresponding to the variable current source 2 in FIG. 1) includes a transistor $Q_{37}$ having a collector connected to the emitter of the transistor $Q_3$, an emitter connected through a resistor $R_{34}$ to the ground and a base connected to the base of the transistor $Q_{38}$ in the input current detecting circuit 41.

In these third and fourth embodiments, similarly to the first and second embodiments, if the input current Iref becomes small, the current flowing through the variable current source correspondingly becomes small, and therefore, the base current of the transistor $Q_3$ becomes small, with the result that the error between the input current Iref and the output current $I_O$ becomes small. In addition, since the third and fourth embodiments can be constituted of the transistors of the number smaller than that of the transistors required in the first embodiment, the necessary circuit area can be reduced.

As mentioned above, the current mirror circuit in accordance with the present invention is advantageous in that even if the value of the input current Iref greatly changes in a range of a few digits, and even if the input current Iref becomes extremely small, the error between the input current and the output current can be maintained at a minimized level. In addition, the error is maintained at the minimized value independently of the variation of the current amplification factors $h_{FEN}$ and $h_{FEP}$.

The invention has thus been shown and described with reference to the specific embodiments. However, it should be noted that the present invention is in no way limited to the details of the illustrated structures but changes and modifications may be made within the scope of the appended claims.

I claim:

1. A current mirror circuit for outputting an output current in proportion to an input current, comprising:

a first transistor having a collector through which said input current flows;

a second transistor having a base connected to a base of said first transistor and a collector through which said output current flows;

a third transistor having a base connected to a collector of said first transistor, and an emitter through which a predetermined current flows;

a fourth transistor having a base connected to an emitter of said third transistor, and an emitter connected to said base of said first and second transistors;

a variable current source connected to cause said predetermined current to flow through said third transistor, the value of said predetermined current being variable; and an input current detecting circuit detecting said input current for controlling said variable current source so as to maintain said predetermined current in proportion to said input current.

2. A current mirror circuit claimed in claim 1 wherein said input current detecting circuit includes:

a fifth transistor having a base connected to said bases of said first and second transistors and a collector through which a current equal to the current flowing through said collector of said first transistor flows;

a sixth transistor connected in series to said fifth transistor; and a seventh transistor having a base connected to an emitter of said sixth transistor and a collector connected to a base of said fourth transistor.

3. A current mirror circuit claimed in claim 2 wherein said variable current source includes an eighth transistor having a base connected to said base of said sixth transistor.

4. A current mirror circuit claimed in claim 3 wherein said input current is a current outputted from a detecting circuit for detecting a received electric field strength.

5. A current mirror circuit claimed in claim 2 wherein said input current is a current outputted from a detecting circuit for detecting a received electric field strength.

6. A current mirror circuit claimed in claim 1 wherein said input current detecting circuit includes:

a fifth transistor having a base connected to said bases of said first and second transistors and a collector through which a current equal to the current flowing through said collector of said first transistor flows;

a sixth transistor having a base and a collector connected in common to said collector of said fifth transistor and said collector of said fourth transistor.

7. A current mirror circuit claimed in claim 6 wherein said variable current source includes a seventh transistor having a base connected to said base of said sixth transistor.

8. A current mirror circuit claimed in claim 7 wherein said input current is a current outputted from a detecting circuit for detecting a received electric field strength.

9. A current mirror circuit claimed in claim 6 wherein said input current is a current outputted from a detecting circuit for detecting a received electric field strength.

10. A current mirror circuit claimed in claim 1 wherein said input current detecting circuit includes:

a fifth transistor having a base connected to said bases of said first and second transistors and a collector through which a current equal to the current flowing through said collector of said first transistor flows;

a sixth transistor having a collector connected to said collector of said fifth transistor, and a base connected to said collector of said fourth transistor.

11. A current mirror circuit claimed in claim 10 wherein said variable current source includes a seventh transistor having a base connected to said base of said sixth transistor.

12. A current mirror circuit claimed in claim 11 wherein said input current is a current outputted from a detecting circuit for detecting a received electric field strength.

13. A current mirror circuit claimed in claim 10 wherein said input current is a current outputted from a detecting circuit for detecting a received electric field strength.

14. A current mirror circuit for outputting an output current in proportion to an input current, comprising:

a first transistor having a collector through which said input current flows;

a second transistor having a base connected to a base of said first transistor and a collector through which said output current flows;

a third transistor having a base connected to a collector of said first transistor, and an emitter through which a predetermined current flows;

a variable current source connected to cause said predetermined current to flow through said third transistor, the value of said predetermined current being variable; and an input current detecting circuit detecting said input current for controlling said variable current source so as to maintain said predetermined current in proportion to said input current.

15. A current mirror circuit claimed in claim 14 wherein said input current detecting circuit includes:

a fourth transistor having a base connected to said emitter of said third transistor and an emitter connected to said bases of said first and second transistors; and a fifth transistor connected in series to said fourth transistor, and having a collector and a base connected to each other.

16. A current mirror circuit claimed in claim 15 wherein said variable current source includes a sixth transistor having a base connected to said base of said fifth transistor.

17. A current mirror circuit claimed in claim 16 wherein said input current is a current outputted from a detecting circuit for detecting a received electric field strength.

18. A current mirror circuit claimed in claim 15 wherein said input current is a current outputted from a detecting circuit for detecting a received electric field strength.

* * * * *